US011352892B2

(12) United States Patent
Virkler

(10) Patent No.: US 11,352,892 B2
(45) Date of Patent: Jun. 7, 2022

(54) SEAL ELEMENT FOR SEALING A JOINT BETWEEN A ROTOR BLADE AND A ROTOR DISK

(71) Applicant: Raytheon Technologies Corporation, Farmington, CT (US)

(72) Inventor: Scott D. Virkler, Ellington, CT (US)

(73) Assignee: Raytheon Technologies Corporation, Farmington, CT (US)

( * ) Notice: Subject to any disclaimer, the term of this patent is extended or adjusted under 35 U.S.C. 154(b) by 0 days.

(21) Appl. No.: 16/851,832

(22) Filed: Apr. 17, 2020

(65) Prior Publication Data

US 2021/0324749 A1 Oct. 21, 2021

(51) Int. Cl.
*F01D 5/30* (2006.01)
*F01D 11/00* (2006.01)

(52) U.S. Cl.
CPC ..... *F01D 5/3015* (2013.01); *F01D 11/006* (2013.01); *F05B 2240/57* (2013.01)

(58) Field of Classification Search
CPC ... F01D 5/3015; F01D 11/006; F05B 2240/57
See application file for complete search history.

(56) References Cited

U.S. PATENT DOCUMENTS 3,853,425 A * 12/1974 Scalzo ..... F01D 5/18 416/95
3,918,842 A 11/1975 Longley
4,500,098 A 2/1985 Wilcox
5,257,909 A 11/1993 Glynn
6,315,298 B1 11/2001 Kildea
6,375,429 B1 4/2002 Halila
6,565,322 B1 5/2003 Lieser
8,016,565 B2 * 9/2011 Berg ..... F01D 11/006 416/219 R
8,038,405 B2 * 10/2011 Ward ..... F16J 15/0887 416/219 R
8,215,914 B2 7/2012 Danescu
8,985,960 B2 * 3/2015 Connor ..... F16J 15/0887 416/219 R
9,175,573 B2 11/2015 Cairo
9,470,098 B2 10/2016 Latimer
9,822,656 B2 11/2017 Bricaud
10,393,135 B2 8/2019 Montgomery
2010/0008782 A1 1/2010 Danescu
2012/0251328 A1 10/2012 Connor
(Continued)

OTHER PUBLICATIONS

EP search report for EP21157573.3 dated Jul. 27, 2021.

*Primary Examiner* — Christopher Verdier
*Assistant Examiner* — Michael K. Reitz
(74) *Attorney, Agent, or Firm* — Getz Balich LLC

(57) ABSTRACT

A rotor assembly is provided for a piece of rotational equipment. This rotor assembly includes a rotor disk, a rotor blade and a seal element. The rotor disk is configured to rotate about a rotational axis. The rotor disk extends axially along the rotational axis to a rotor disk end face. The rotor blade includes an attachment. The attachment attaches the rotor blade to the rotor disk. The seal element is configured to seal a gap between the rotor disk and the attachment. The seal element has a longitudinal centerline that extends along an interface between the rotor disk and the attachment at the rotor disk end face.

17 Claims, 14 Drawing Sheets

(56) References Cited

U.S. PATENT DOCUMENTS

| | | | | |
|---|---|---|---|---|
| 2014/0144157 | A1* | 5/2014 | Cairo | F01D 5/3092 60/805 |
| 2014/0165591 | A1 | 6/2014 | Thomen | |
| 2016/0208625 | A1* | 7/2016 | Garcia-Crespo | F01D 5/3007 |

* cited by examiner

26

SEAL ELEMENT FOR SEALING A JOINT BETWEEN A ROTOR BLADE AND A ROTOR DISK

This invention was made with Government support awarded by the United States. The Government has certain rights in this invention.

BACKGROUND OF THE DISCLOSURE

1. Technical Field

This disclosure relates generally to rotational equipment and, more particularly, to sealing a joint between a rotor blade and a rotor disk.

2. Background Information

A rotor assembly for a gas turbine engine may include a plurality of rotor blades arranged around a rotor disk. Each rotor blade may be mounted to the rotor disk by a mechanical joint such as, for example, a dovetail interface. While various types and configurations of rotor assemblies are known in the art, there is still room in the art for improvement. In particular, there is need in the art for reducing fluid leakage through mechanical joints between rotor blades and a rotor disk.

SUMMARY OF THE DISCLOSURE

According to an aspect of the present disclosure, a rotor assembly is provided for a piece of rotational equipment. This rotor assembly includes a rotor disk, a rotor blade and a seal element. The rotor disk is configured to rotate about a rotational axis. The rotor disk extends axially along the rotational axis to a rotor disk end face. The rotor blade includes an attachment. The attachment attaches the rotor blade to the rotor disk. The seal element is configured to seal a gap between the rotor disk and the attachment. The seal element has a longitudinal centerline that extends along an interface between the rotor disk and the attachment at the rotor disk end face.

According to another aspect of the present disclosure, another rotor assembly is provided for a piece of rotational equipment. This rotor assembly includes a rotor disk, a rotor blade and a seal element. The rotor disk is configured to rotate about a rotational axis. The rotor disk extends axially along the rotational axis to a rotor disk end face. The rotor blade includes an attachment. The attachment attaches the rotor blade to the rotor disk. The seal element is configured to seal a gap between the rotor disk and the attachment. The seal element is seated in a groove that extends axially partially into the rotor disk from the rotor disk end face. The groove extends within the rotor disk along an interface between the rotor disk and the attachment.

According to still another aspect of the present disclosure, still another rotor assembly is provided for a piece of rotational equipment. This rotor assembly includes a rotor disk, a rotor blade, a plate and a seal element. The rotor disk is configured to rotate about a rotational axis. The rotor disk extends axially along the rotational axis to a rotor disk end face. The rotor blade includes an attachment. The attachment attaches the rotor blade to the rotor disk. The plate is attached to the rotor disk at the rotor disk end face. The plate overlaps the attachment. The seal element is configured to seal a gap between the rotor disk and the attachment. The seal element is axially between and engaged with the attachment and the rotor disk.

The longitudinal centerline may follow a tortuous trajectory.

The seal element may be seated in a groove formed by at least the rotor disk and the attachment.

The groove may extend axially partially into the rotor disk from the rotor disk end face.

The rotor disk may include a slot surface that at least partially forms a slot in the rotor disk. The attachment may be seated within the slot. The groove may extend laterally partially into the rotor disk from the slot surface.

The rotor disk may include a slot surface that at least partially forms a slot in the rotor disk. The attachment may be seated within the slot. The groove may extend radially partially into the rotor disk from the slot surface.

The rotor disk may include a dovetail slot. The attachment may be configured as a dovetail attachment that is seated within the dovetail slot.

The rotor assembly may include a plate mounted to the attachment. The plate may overlap the attachment. The seal element may be compressed axially between the plate and the rotor disk.

The plate may be bonded to the attachment.

The rotor blade may also include a platform that extends laterally between a platform first edge and a platform second edge opposite the platform first edge. The plate may extend laterally between a plate first side and a plate second side opposite the plate second side. The plate first side may be laterally aligned with the platform first edge. In addition or alternatively, the plate second side may be laterally aligned with the platform second edge.

The rotor assembly may also include a second rotor blade, a second seal element and a second plate. The second rotor blade may include a second attachment. The second attachment may attach the second rotor blade to the rotor disk. The second rotor blade may be laterally adjacent the rotor blade. The second seal element may be configured to seal a second gap between the rotor disk and the second attachment. The second plate may be mounted to the second attachment. The second plate may overlap the second attachment and may be laterally adjacent the plate. The second seal element may be compressed axially between the second plate and the rotor disk.

The longitudinal centerline may follow a U-shaped trajectory.

The seal element may be configured as or otherwise include a rope seal element.

The seal element may be configured as or otherwise include a compliant seal element.

The rotor blade may also include an airfoil.

The rotor assembly may also include a second rotor blade and a second seal element. The second rotor blade may include a second attachment. The second attachment may attach the second rotor blade to the rotor disk. The second rotor blade may be laterally adjacent the rotor blade. The second seal element may be configured to seal a second gap between the rotor disk and the second attachment. The second seal element may have a second longitudinal centerline that extends along an interface between the rotor disk and the second attachment at the rotor disk end face.

The rotor assembly may also include a second rotor blade. This second rotor blade may include a second attachment. This second attachment may attach the second rotor blade to the rotor disk. The second rotor blade may be laterally adjacent the rotor blade. The seal element may also be configured to seal a second gap between the rotor disk and the second attachment. The longitudinal centerline may extend along an interface between the rotor disk and the second attachment at the rotor disk end face.

The rotor blade may be configured as or otherwise include a compressor blade.

The present disclosure may include any one or more of the individual features disclosed above and/or below alone or in any combination thereof.

The foregoing features and the operation of the invention will become more apparent in light of the following description and the accompanying drawings.

DETAILED DESCRIPTION

Figure 1:
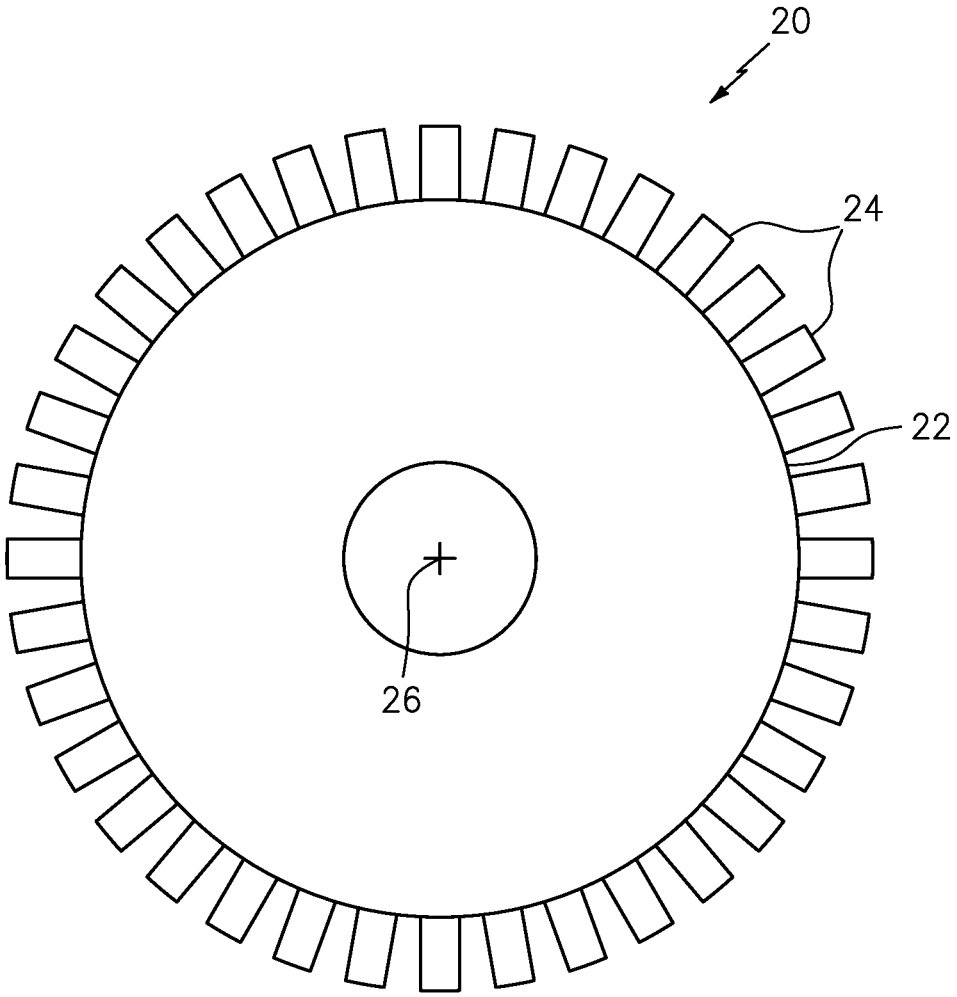
FIG. 1 is a schematic illustration of a bladed rotor assembly.

FIG. 1 illustrates a bladed rotor assembly 20 for a piece of rotational equipment. An example of such a piece of rotational equipment is a gas turbine engine for an aircraft propulsion system, an exemplary embodiment of which is described below in further detail with respect to FIG. 17. However, the rotor assembly 20 of the present disclosure is not limited to such an aircraft application nor a gas turbine engine application. The rotor assembly 20, for example, may alternatively be configured with rotational equipment such as an industrial gas turbine engine, a wind turbine, a water turbine or any other apparatus which includes a bladed rotor.

The rotor assembly 20 of FIG. 1 includes a rotor disk 22 and a plurality of rotor blades 24; e.g., compressor blades. The rotor disk 22 of FIG. 1 is configured to rotate about a rotational axis 26, which may also be an axial centerline of the rotor assembly 20 and/or the piece of rotational equipment.

Figure 2:
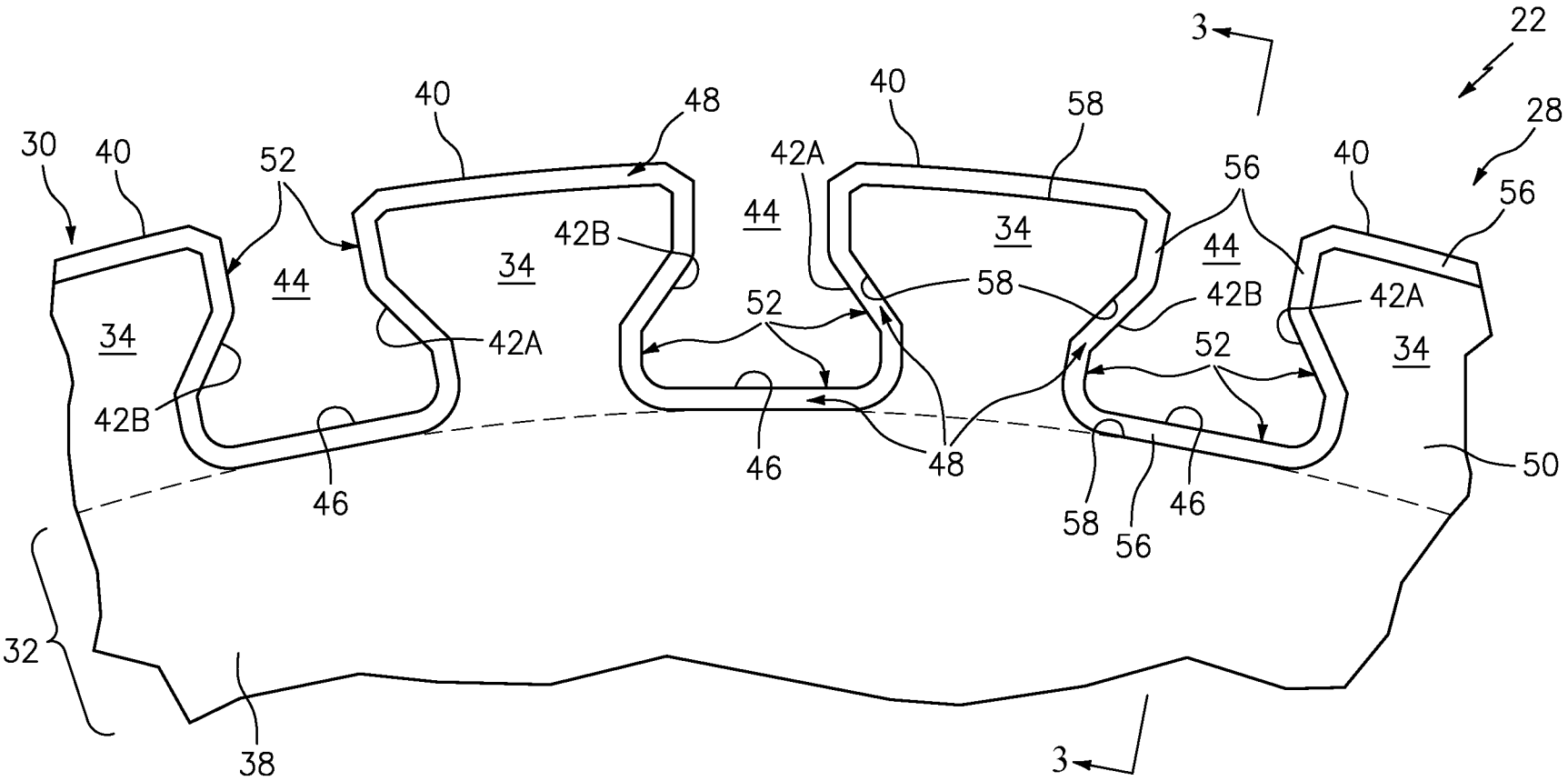
FIG. 2 is an end view illustration of a portion of a rotor disk.

Referring to FIG. 2, the rotor disk 22 includes a rotor disk rim 28 at a radial outer periphery 30 of the rotor disk 22. This rotor disk rim 28 includes a rim base 32 and a plurality of rim lugs 34.

Figure 3:
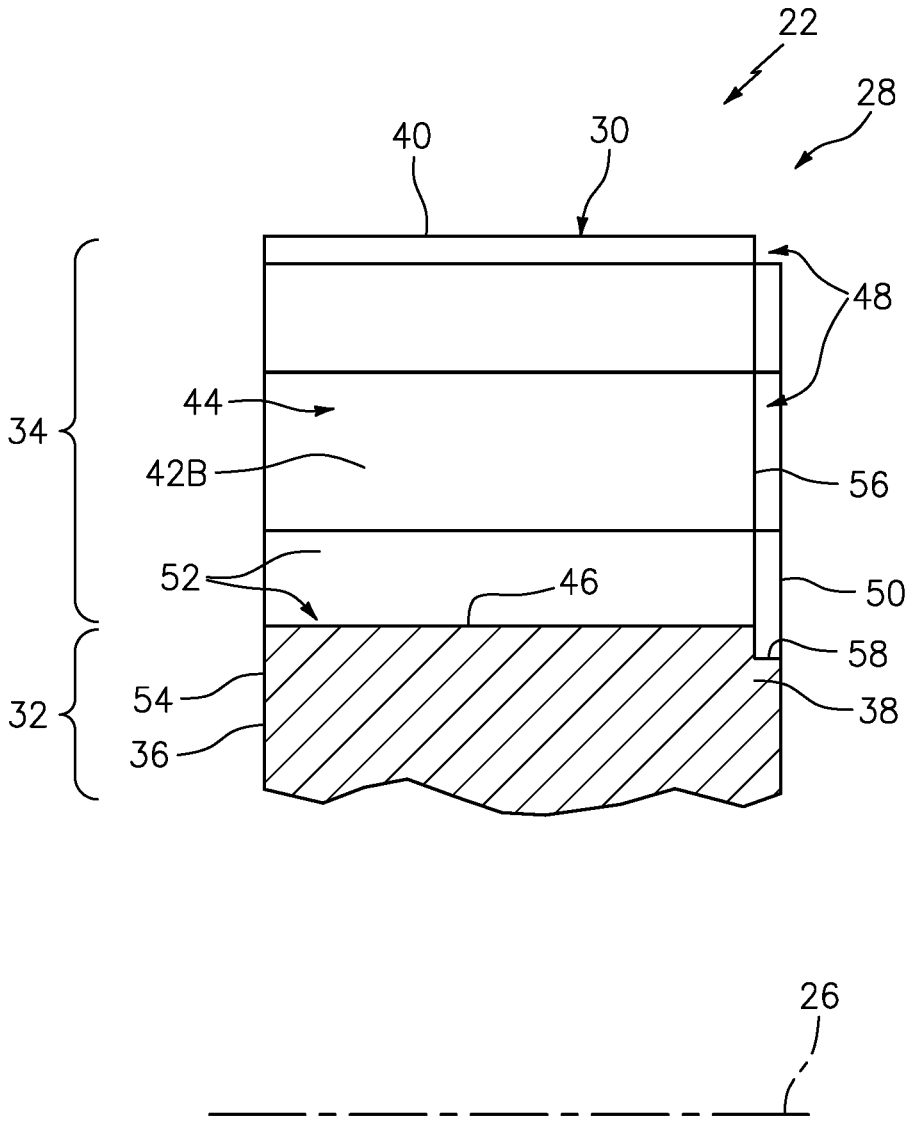
FIG. 3 is a side sectional illustration of a portion of the rotor disk taken along line 3-3 in FIG. 2.

The rim base 32 extends circumferentially about (e.g., completely around) the rotational axis 26. Referring to FIG. 3, the rim base 32 extends axially along the rotational axis 26 between a first (e.g., forward and/or upstream) end 36 of the rotor disk rim 28 and a second (e.g., aft and/or downstream) end 38 of the rotor disk rim 28.

The rim lugs 34 of FIG. 2 are arranged circumferentially about the rim base 32 and the rotational axis 26 in an annular array. Each of the rim lugs 34 projects radially out, in an outward direction relative to the rotational axis 26, from an outer periphery of the rim base 32 to a respective distal lug end surface 40. Each of the rim lugs 34 extends laterally (e.g., in a circumferential or tangential direction relative to the rotational axis 26) between opposing lug first and second side surfaces 42A and 42B (generally referred to as "42"). Referring to FIG. 3, each of the rim lugs 34 extends (e.g., substantially) axially along the rotational axis 26 between the rim first end 36 and the rim second end 38.

Referring to FIG. 2, the rim lugs 34 are circumferentially spaced about (e.g., completely around) the rotational axis 26 so as to form an annular array of attachment slots 44; e.g., dovetail slots. Each of the attachment slots 44 is disposed laterally between and formed by a circumferentially adjacent/neighboring pair of the rim lugs 34 and their side surfaces 42. Each attachment slot 44 extends radially inward into the rotor disk 22 from respective distal lug end surfaces 40 to a respective slot end surface 46; e.g., a slot bottom surface. Each attachment slot 44 extends laterally between a respective one of the lug first side surfaces 42A and a respective one of the lug second side surfaces 42B. Each attachment slot 44 may extend (e.g., substantially) axially through (or axially into) the rotor disk 22 as shown, for example, in FIG. 3.

The rotor disk rim 28 of FIGS. 2 and 3 is also configured with at least one (e.g., continuous) notch 48. The notch 48 of FIG. 2 is configured to follow (e.g., continuously/uninterrupted) along a corner of the rotor disk 22 between (a) a second end face 50 of the rotor disk 22 and its rotor disk rim 28 and (b) the distal lug end surfaces 40 and the slot surfaces 52. Briefly, the rotor disk second end face 50 is located at (e.g., on, adjacent or proximate) the rim second end 38. Each slot surface 52 includes/is defined by the surface(s) (e.g., 42A, 42B and 46) forming a respective one of the attachment slots 44. Each slot surface 52 extends (e.g., laterally and radially) between and is contiguous with a laterally neighboring (e.g., adjacent) pair of the distal lug end surfaces 40. Referring to FIG. 3, each slot surface 52 extends axially from a first end face 54 of the rotor disk 22 at the rim first end 36 to the notch 48.

The notch 48 of FIG. 3 extends partially axially into the rotor disk 22 and its rotor disk rim 28 from the rotor disk second end face 50 to a notch end surface 56. This notch end surface 56 extends (e.g., laterally and radially) from the surface(s) (e.g., 40, 42 and 46) to a notch side surface 58. The notch 48 of FIG. 3 also extends partially (e.g., laterally and radially) from the surface(s) (e.g., 40, 42 and 46) to the notch side surface 58. This notch side surface 58 extends axially from the rotor disk second end face 50 to the notch end surface 56. An exterior corner between the surfaces (e.g., 40, 42, 46 and 56) may be eased (e.g., rounded, chamfered, etc.). An exterior corner between the surfaces (e.g., 50 and 58) may be eased (e.g., rounded, chamfered, etc.). An interior corner between the surfaces (e.g., 56 and 58) may be eased (e.g., rounded, sloped, etc.).

Figure 4:
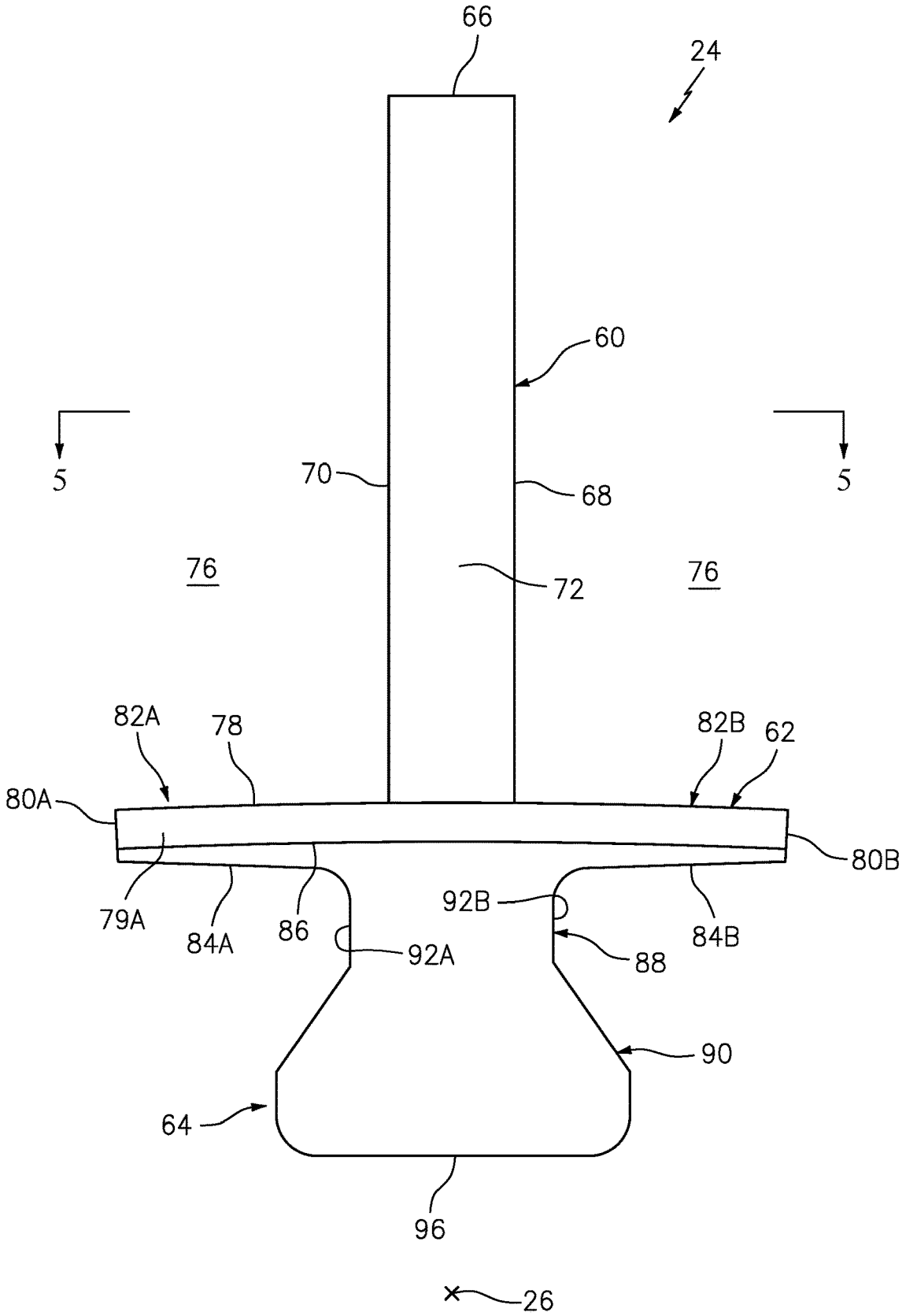
FIG. 4 is an end view illustration of a rotor blade.
Figure 5:
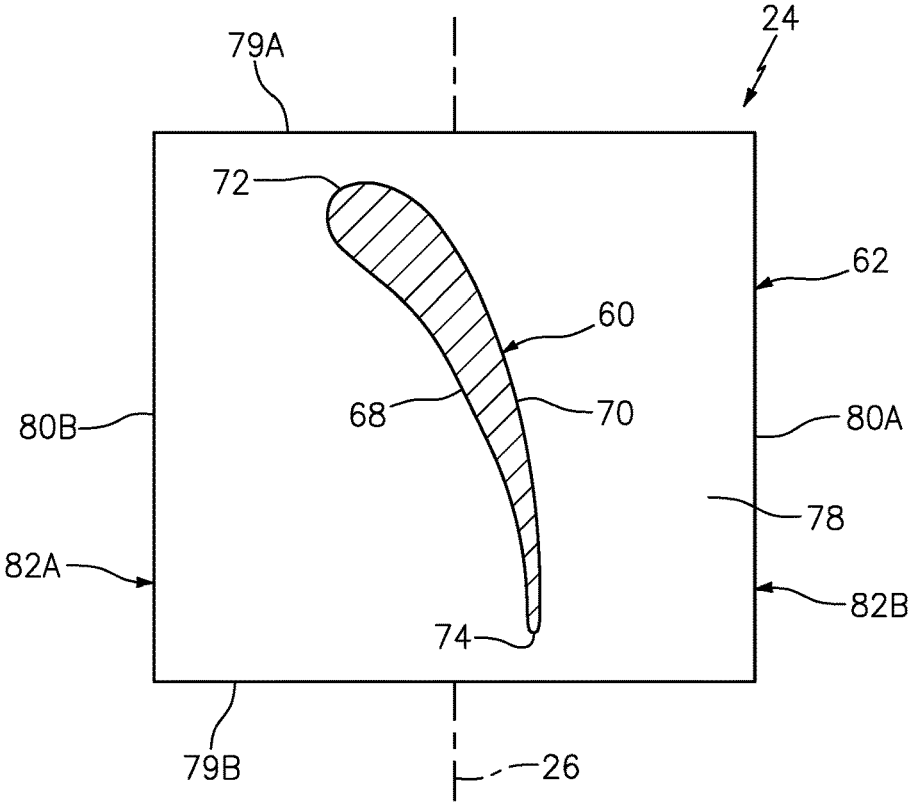
FIG. 5 is a cross-sectional illustration of the rotor blade taken along line 5-5 in FIG. 4.

Referring to FIG. 4, each rotor blade 24 includes a rotor blade airfoil 60, a rotor blade platform 62 and a rotor blade attachment 64. The rotor blade airfoil 60 projects radially out from the rotor blade platform 62 in a spanwise direction to a (e.g., unshrouded) airfoil tip 66. Referring to FIG. 5, the rotor blade airfoil 60 includes an airfoil first (e.g., pressure and/or concave) side surface 68 and an airfoil second (e.g., suction and/or convex) side surface 70. These first and second side surfaces 68 and 70 extend along a camber line of the rotor blade airfoil 60 between and meet at an airfoil (e.g., forward and/or upstream) leading edge 72 and an airfoil (e.g., aft and/or downstream) trailing edge 74.

The rotor blade platform 62 of FIG. 4 is radially between and connected to the rotor blade airfoil 60 and the rotor blade attachment 64. The rotor blade platform 62 is configured to form a portion of an inner peripheral boarder of a gas path 76 (e.g., a core gas path) extending axially across the rotor assembly 20; e.g., a gas path into which the rotor blade airfoils 60 radially extend. The rotor blade platform 62 of FIG. 5, for example, includes an outer platform surface 78 that extends axially along the rotational axis 26 between a platform first (e.g., forward and/or upstream) edge 79A and a platform second (e.g., aft and/or downstream) edge 79B. The outer platform surface 78 extends circumferentially between opposing platform first and second side edges 80A and 80B (generally referred to as "80").

Referring to FIG. 4, the rotor blade platform 62 is configured with a platform first side segment 82A (e.g., a side projection and/or wing) and a platform second side segment 82B (e.g., a side projection and/or wing), which segments 82A and 82B are generally referred to as "82". The platform first side segment 82A projects circumferentially away from the rotor blade airfoil 60 and the rotor blade attachment 64 to the first side edge 80A. This platform first side segment 82A is thereby cantilevered from the rotor blade attachment 64. The platform first side segment 82A extends radially from the outer platform surface 78 to an inner projection surface 84A as well as a first segment of an inner platform surface 86. The platform second side segment 82B projects circumferentially away from the rotor blade airfoil 60 and the rotor blade attachment 64 to the second side edge 80B. This platform second side segment 82B is thereby cantilevered from the rotor blade attachment 64. The platform second side segment 82B extends radially from the outer platform surface 78 to an inner projection surface 84B as well as a second segment of inner platform surface 86.

Figure 6:
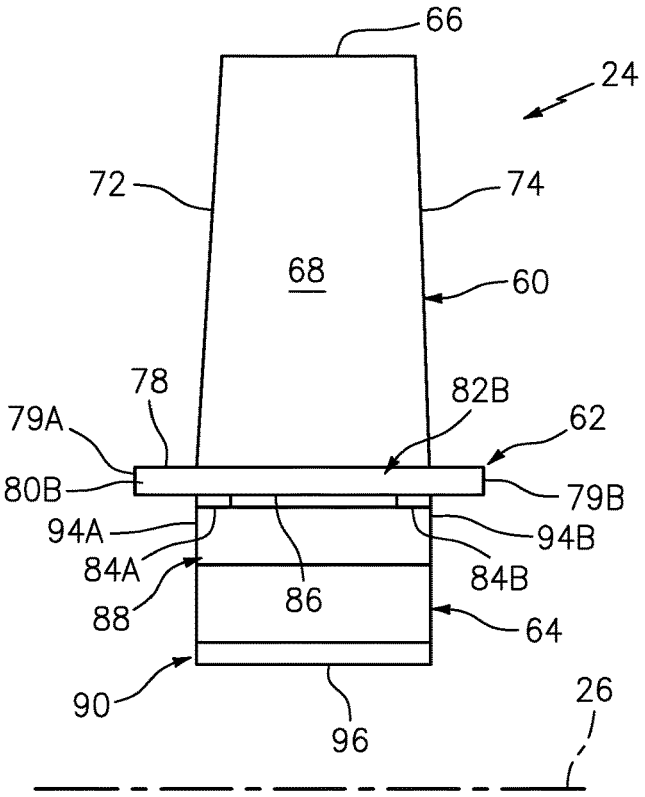
FIG. 6 is a side view illustration of the rotor blade.

The rotor blade attachment 64 may be configured as a dovetail attachment. The rotor blade attachment 64 of FIG. 4, for example, includes a attachment neck 88 and an attachment root 90. The attachment neck 88 extends radially between and is connected to the rotor blade platform 62 and the attachment root 90. The attachment neck 88 extends laterally between opposing neck first and second side surfaces 92A and 92B (generally referred to as "92"). Referring to FIG. 6, the attachment neck 88 extends (e.g., substantially) axially along the rotational axis 26 between a first (e.g., forward and/or upstream) end 94A of the attachment 64 and a second (e.g., aft and/or downstream) end 94B of the attachment 64.

The attachment root 90 extends (e.g., substantially) axially along the rotational axis 26 between the attachment first end 94A and the attachment second end 94B. The attachment root 90, for example, may extend along a trajectory from the attachment first end 94A to the attachment second end 94B, where the trajectory is parallel with the rotational axis 26. Alternatively, the trajectory may be non-parallel with (e.g., slightly angularly offset from) the rotational axis 26 such that the trajectory has a relatively large axial component and a relatively small lateral component. The attachment root 90 of FIG. 4 flares laterally out from the attachment neck 88 so as to form, for example, a dovetail root. The present disclosure, however, is not limited to such an exemplary attachment configuration. The attachment root 90 projects radially inward from the attachment neck 88 to an attachment distal end surface 96; e.g., an attachment bottom surface.

Figure 7:
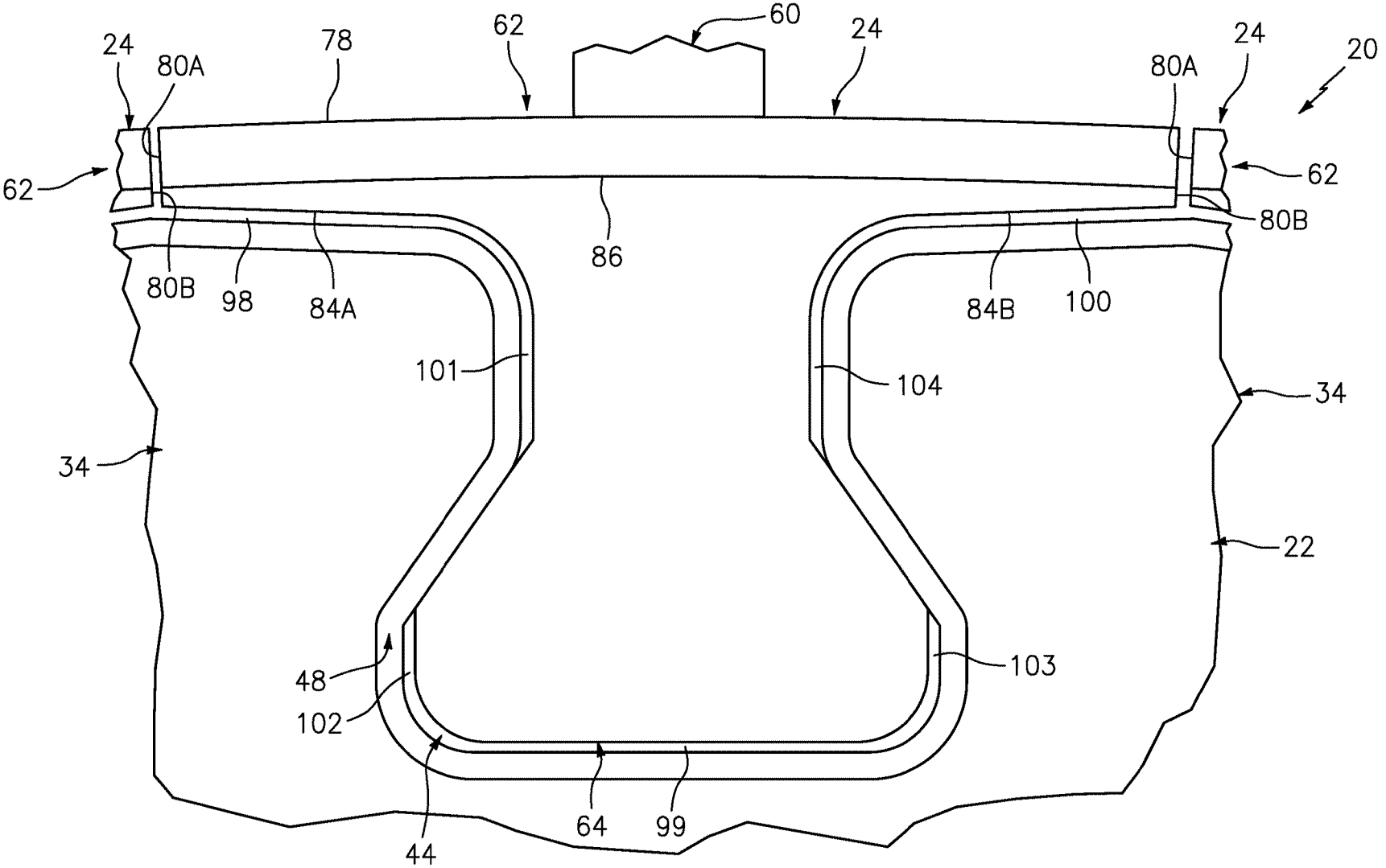
FIG. 7 is a partial end view illustration of interfaces between a plurality of the rotor blades and the rotor disk, where platforms of two of the rotor blades are partially shown.

Referring to FIG. 7, the rotor blades 24 are arranged circumferentially around the rotor disk 22 and the rotational axis 26 in an annular array. Each of the rotor blades 24 is attached to the rotor disk 22 via a mechanical joint; e.g., a dovetail interface. The rotor blade attachment 64 of each rotor blade 24, for example, is mated with (e.g., slides into and is seated within) a respective one of the attachment slots 44 in the rotor disk 22.

During rotational equipment operation and/or rotation of the rotor assembly 20 about its rotational axis 26, fluid (e.g., compressed air) may leak across the rotor assembly 20. For example, the fluid may leak axially through radial gaps 98-100 between the rim lugs 34 and the rotor blade 24 and its components 62 and 64. Fluid may also or alternatively leak axially through lateral gaps 101-104 between the rim lugs 34 and the rotor blade attachments 64. Such leakage may reduce performance of the rotational equipment. Therefore, to reduce and/or prevent such fluid leakage across the rotor assembly 20, the rotor assembly 20 of the present disclosure further includes a seal assembly 106, an example of which is described below with reference to FIGS. 8, 11 and 15.

Figure 8:
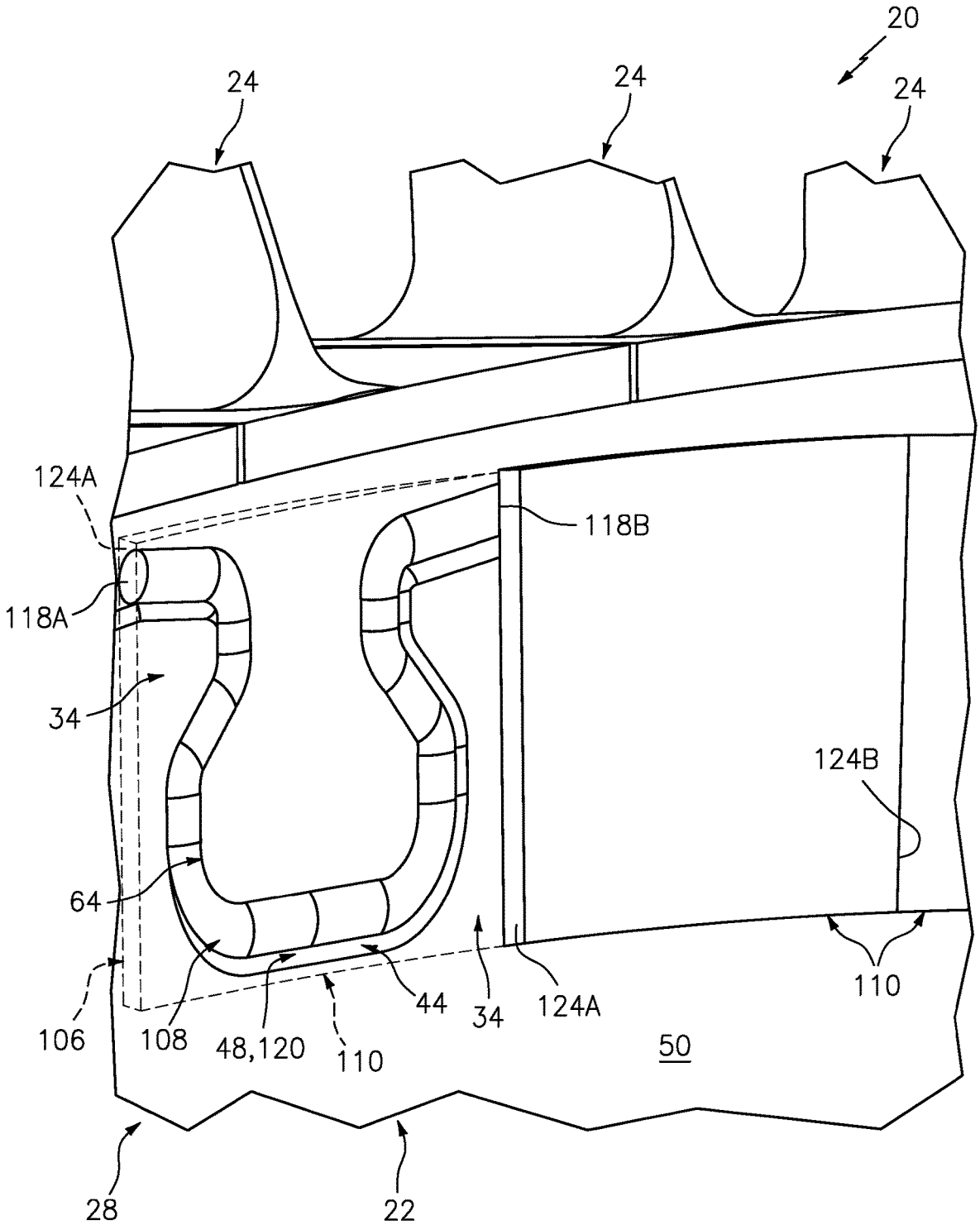
FIG. 8 is a partial perspective illustration of a seal assembly configured with the rotor disk and the rotor blades.

The seal assembly 106 of FIG. 8 includes one or more (e.g., compliant) seal elements 108 (one visible in FIG. 8) and one or more blade plates 110 (one shown via dashed lines in FIG. 8). Each of the seal elements 108 may be associated with a respective one of the blade plates 110 into an element-plate pair.

Figure 9:
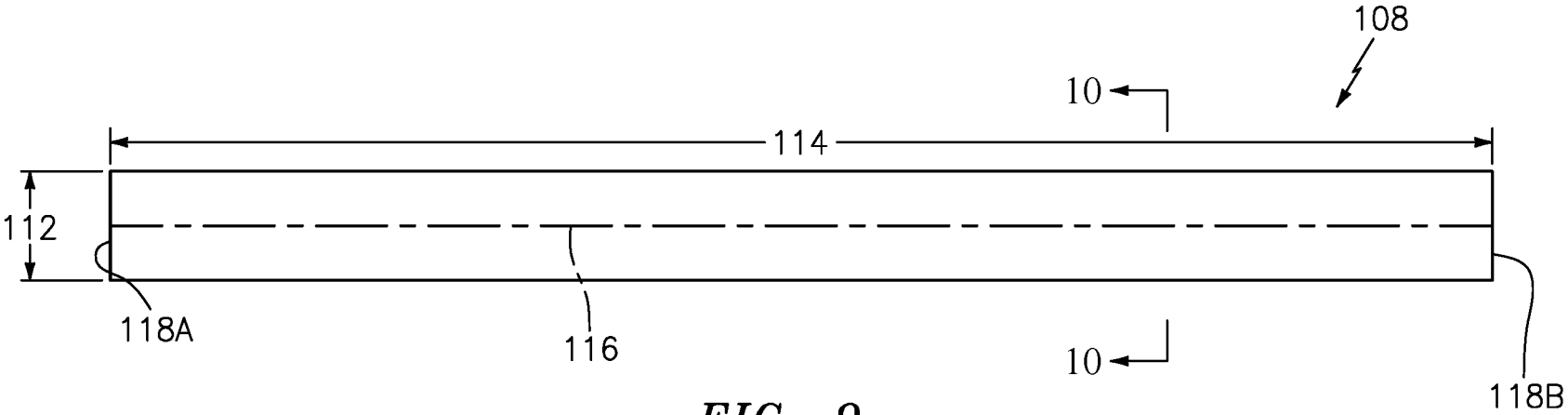
FIG. 9 is an illustration of a seal element in a relaxed and/or unassembled state.

Each seal element 108 of FIG. 9 (shown in a relaxed and/or non-assembled state) is configured as an elongated seal element. This seal element 108, for example, has a relatively small cross-sectional width 112 (e.g., diameter) and a relatively long longitudinal length 114. This longitudinal length 114 may be measured along a longitudinal centerline 116 of the seal element 108 between opposing ends 118A and 118B (generally referred to as "118") of the seal element 108. The longitudinal length 114 may be at least four times (4×), ten times (10×), fifteen times (15×), twenty times (20×), or more the cross-sectional width 112; e.g., the length 114 may be between 10× and 30× the width 112. The present disclosure, however, is not limited to the foregoing exemplary length-to-width ratios. The longitudinal length 114 may be sized such that the seal element 108 covers one or more or each of the gaps 98-104 between the elements 22 and 24; see FIGS. 7 and 11.

Figure 10:
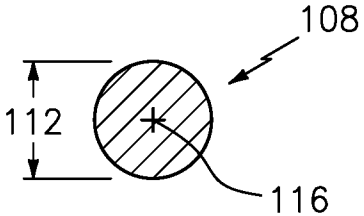
FIG. 10 is a cross-sectional illustration of the seal element taken along line 10-10 in FIG. 9.
Figure 12:
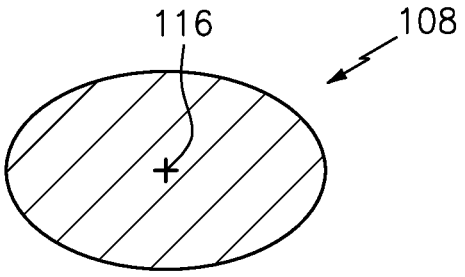
FIGS. 12-13B are cross-sectional illustrations of alternate seal element geometries.
Figure 13A:
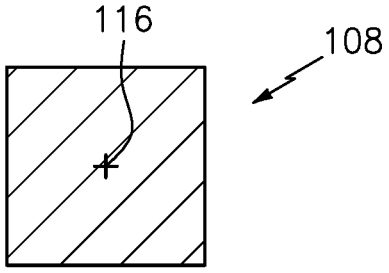
Figure 13B:
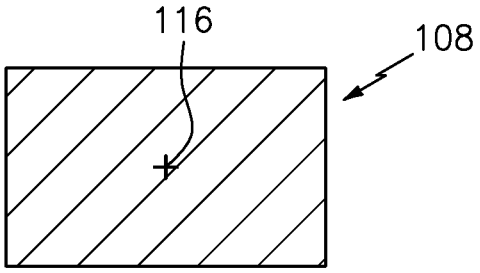

In a relaxed/unassembled state as shown in FIG. 10, each seal element 108 may have a circular cross-sectional geometry when viewed, for example, in a plane perpendicular to the longitudinal centerline 116. The present disclosure, however, is not limited to such an exemplary seal element cross-sectional geometry. For example, in other embodiments, each seal element 108 may be configured with a non-circular cross-sectional geometry. Examples of non-circular cross-sectional geometries include, but are not limited to, an oval or elliptical cross-sectional geometry (e.g., see FIG. 12), a rectangular cross-sectional geometry (e.g., see FIGS. 13A and 13B), or any other desired cross-sectional geometry.

Figure 14:
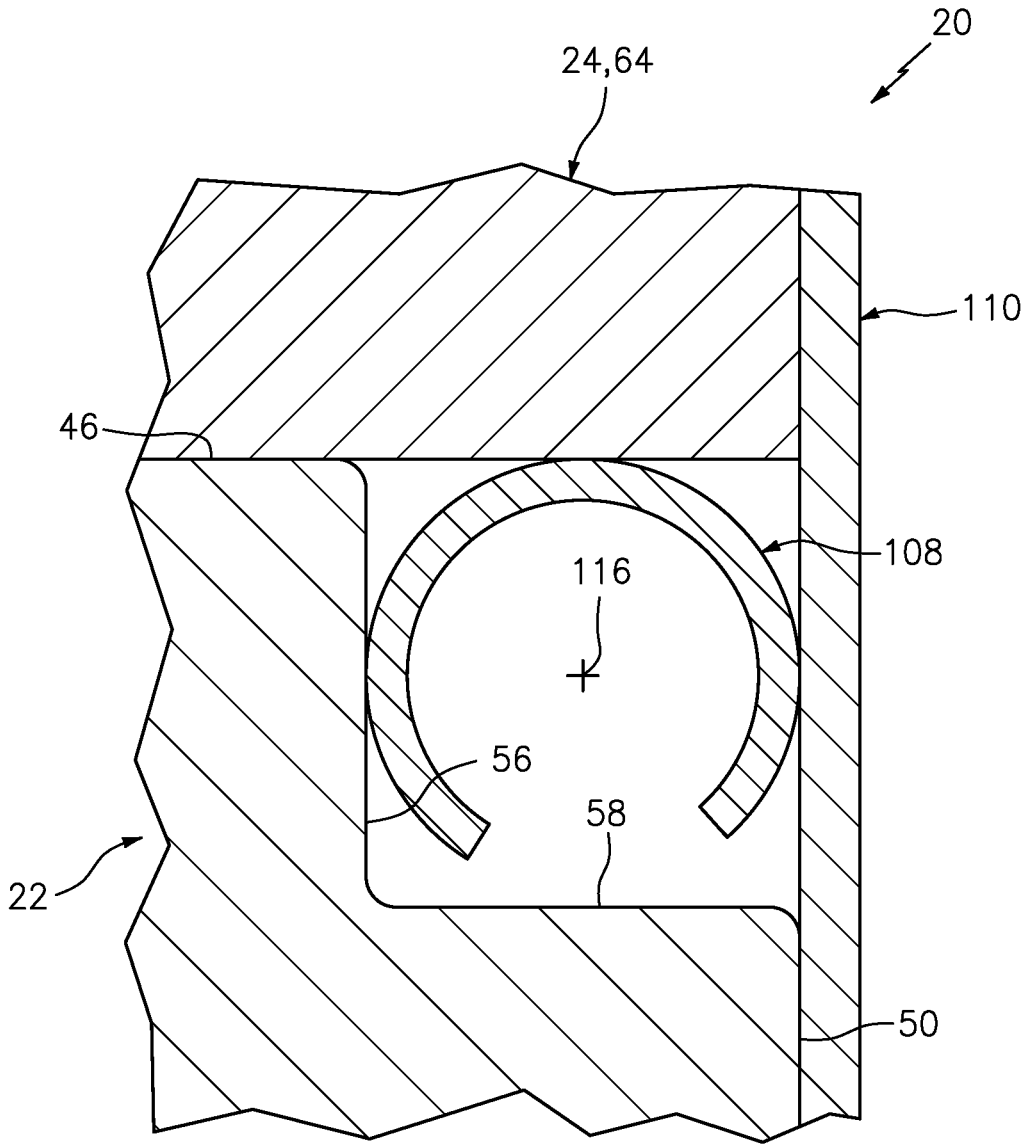
FIG. 14 is a partial side-sectional illustration of an interface between the seal assembly, the rotor disk and an exemplary rotor blade.

Each seal element 108 may be configured as a compliant seal element. Each seal element 108, for example, may be configured as a rope seal element (e.g., a braided wire rope seal element), a (e.g., single strand) wire seal element or a C-type or U-type seal element (see FIG. 14). The present disclosure, however, is not limited to the foregoing exemplary seal element configurations.

Each seal element 108 is formed from seal element material. Examples of the seal element material may include, but are not limited to, metal and polymeric material. Examples of the metal include, but are not limited to, aluminum (Al), nickel (Ni), titanium (Ti), and alloys of any one or more of the foregoing. Examples of the polymeric material may include, but are not limited to, fiber-reinforced thermoplastic material and fiber-reinforced thermoset material. The present disclosure, however, is not limited to the foregoing exemplary seal element materials.

Figure 11:
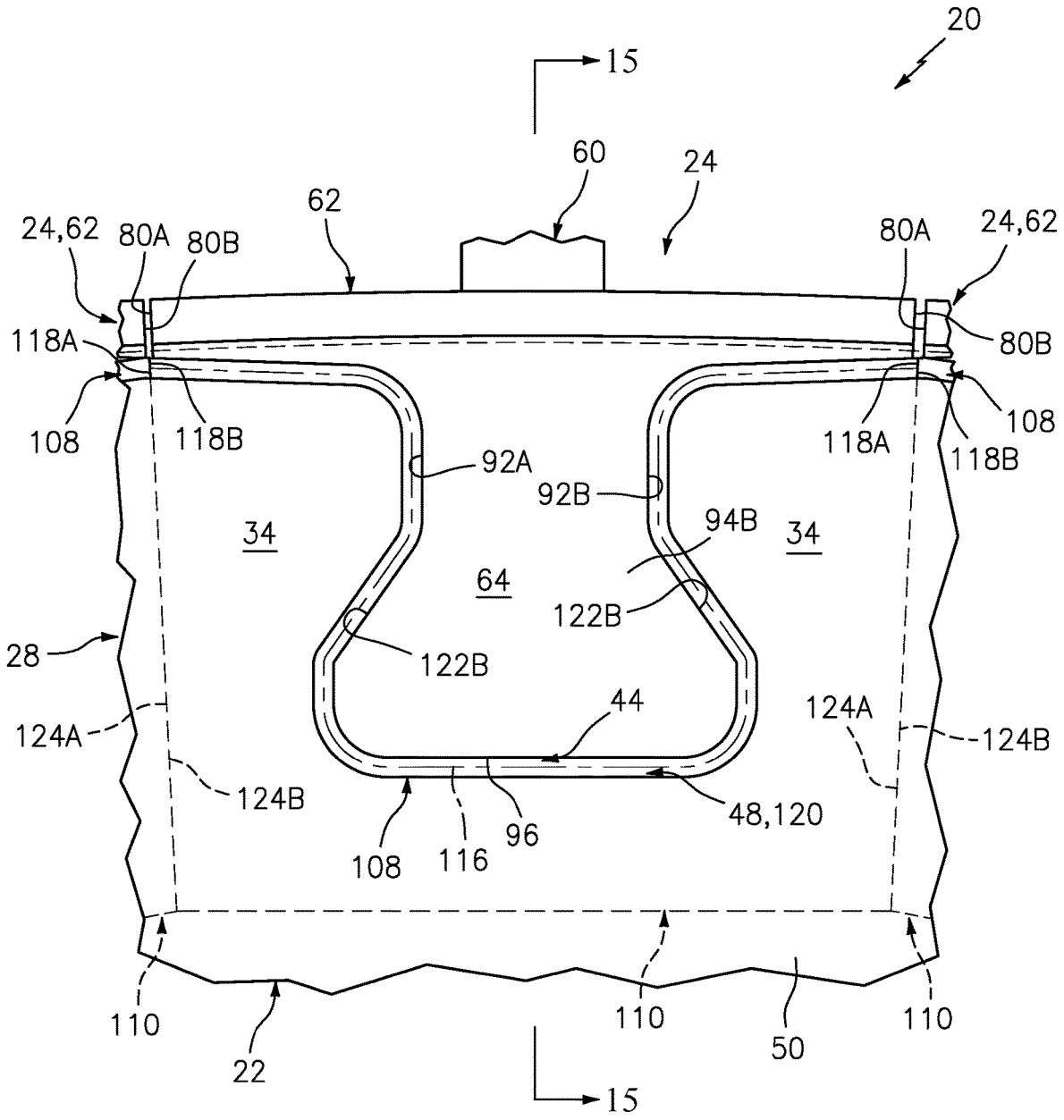
FIG. 11 is a partial end view illustration of the seal assembly configured with the rotor disk and the rotor blades.

Referring to FIGS. 8 and 11, each seal element 108 is configured to seal one or more or each of the gaps 98-104 (see FIG. 7) between the rotor disk 22 and its rotor disk rim 28 and a respective one of the rotor blades 24. Each seal element 108 of FIGS. 8 and 11, for example, is arranged within a groove 120 formed by the rotor disk 22 and a respective one of the rotor blades 24. This groove 120 is formed by portions of the notch end and side surfaces 56 and 58 (see FIGS. 2 and 3) associated with a respective one of the attachment slots 44 as well as surfaces 92, 96, 122A and 122B of a respective one of the rotor blade attachments 64.

Within the groove 120, the longitudinal centerline 116 of each seal element 108 extends along an interface between the rotor disk 22 and the rotor blade attachment 64 of a respective one of the rotor blades 24 at the rotor disk second end face 50. The longitudinal centerline 116 thereby follows a tortuous (e.g., compound curved) trajectory such as, but not limited to, a compound curve trajectory, a O-shaped trajectory, etc. Each seal element end 118A, 118B shown in FIG. 11 is laterally aligned with a respective one of the platform edges 80A, 80B of the rotor blade attachment 64 engaged with the respective seal element 108.

Referring to FIG. 11, each seal element 108 is in an end-to-end arrangement with laterally neighboring (e.g., adjacent) seal elements 108 on opposing sides thereof. Thus, each seal element end 118A, 118B of a respective seal element 108 is laterally abutted against, engages (e.g., contacts) or is otherwise in close proximity to a respective seal element end 118B, 118A of a laterally neighboring one of the seal elements 108. The seal elements 108 may thereby form a segmented, but substantially continuous annular seal element apparatus.

Figure 15:
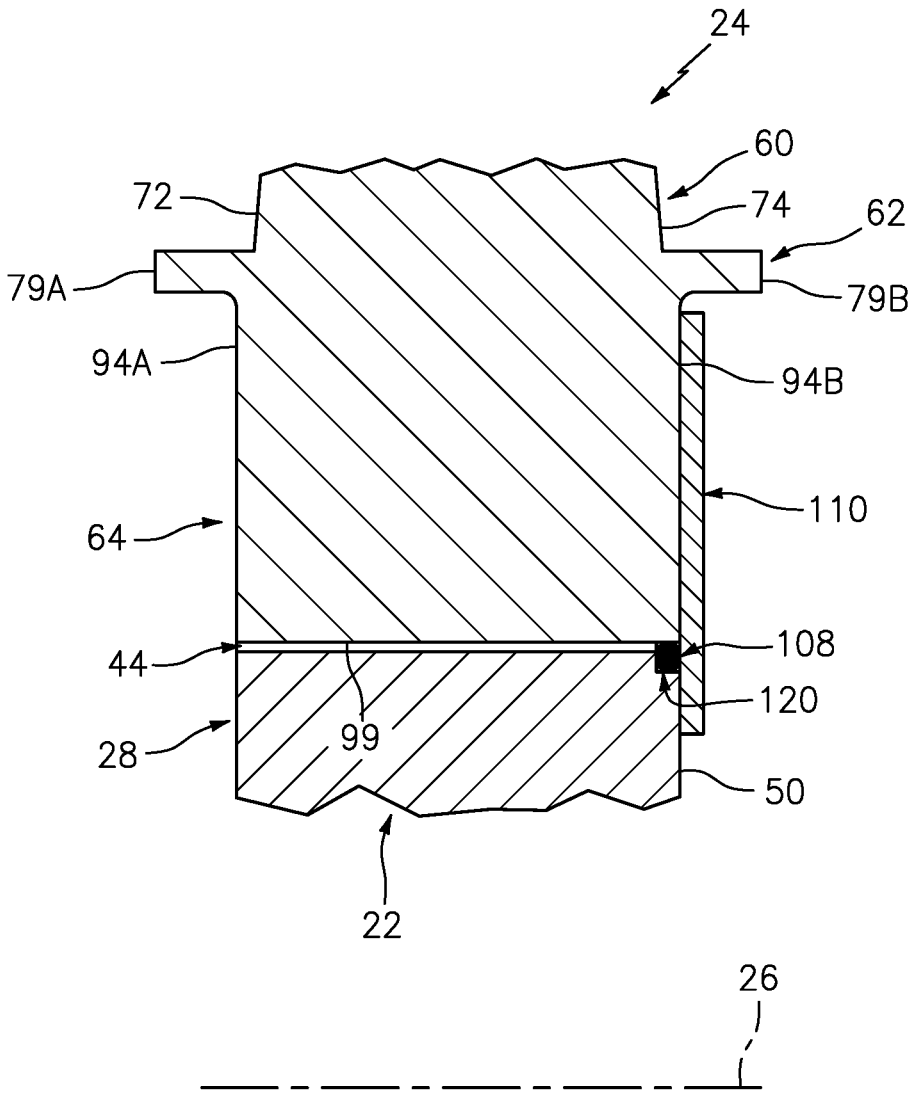
FIG. 15 is a side sectional illustration of the assembly of FIG. 11 taken along line 15-15 in FIG. 11.

Each blade plate 110 is configured to maintain a respective one of the seal elements 108 in sealing engagement with the rotor disk rim 28 and the respective rotor blade attachment 64; see also FIG. 15. Each blade plate 110, for example, (e.g., completely) radially and laterally overlaps the respective rotor blade attachment 64 as well as the respective seal element 108. Each blade plate 110 is arranged at the rim second end 38 and/or the rotor blade second end face 50. Each blade plate 110, for example, is abutted axially against the rotor blade second end face 50 and is attached (e.g., welded, brazed and/or otherwise bonded) to the attachment second end 94B.

Each seal element 108 is arranged axially between (a) a respective one of the blade plates 110 and (b) a respective one of the rotor blade attachments 64 and the rotor disk 22 and its rotor disk rim 28. Referring to FIGS. 11 and 15, each seal element 108 is engaged with each of the rotor assembly components 34, 62, 64 and 110. Each seal element 108 of FIG. 15, for example, may be compressed axially between (a) a respective one of the blade plates 110 and (b) a respective one of the rotor blade attachments 64 and the rotor disk 22 and its rotor disk rim 28. Each blade plate 110 is thereby configured to push the respective seal element 108 against, and seal the gap at, the interface between the respective rotor blade attachment 64 and the rotor disk rim 28.

Each blade plate side 124A, 124B (generally referred to as "124") shown in FIG. 11 is laterally aligned with a respective one of the platform edges 80A, 80B of the rotor blade attachment 64 associated with the respective blade plate 110. Each blade plate side 124A, 124B is also or alternatively laterally aligned with a respective one of the seal element ends 118A, 118B of the respective seal element 108 between that blade plate 110 and the rotor disk 22. Each blade plate side 124A, 124B of each blade plate 110 is also positioned laterally adjacent and may laterally engage (e.g., contact) a respective blade plate side 124B, 124A of a laterally neighboring blade plate 110.

Figure 16:
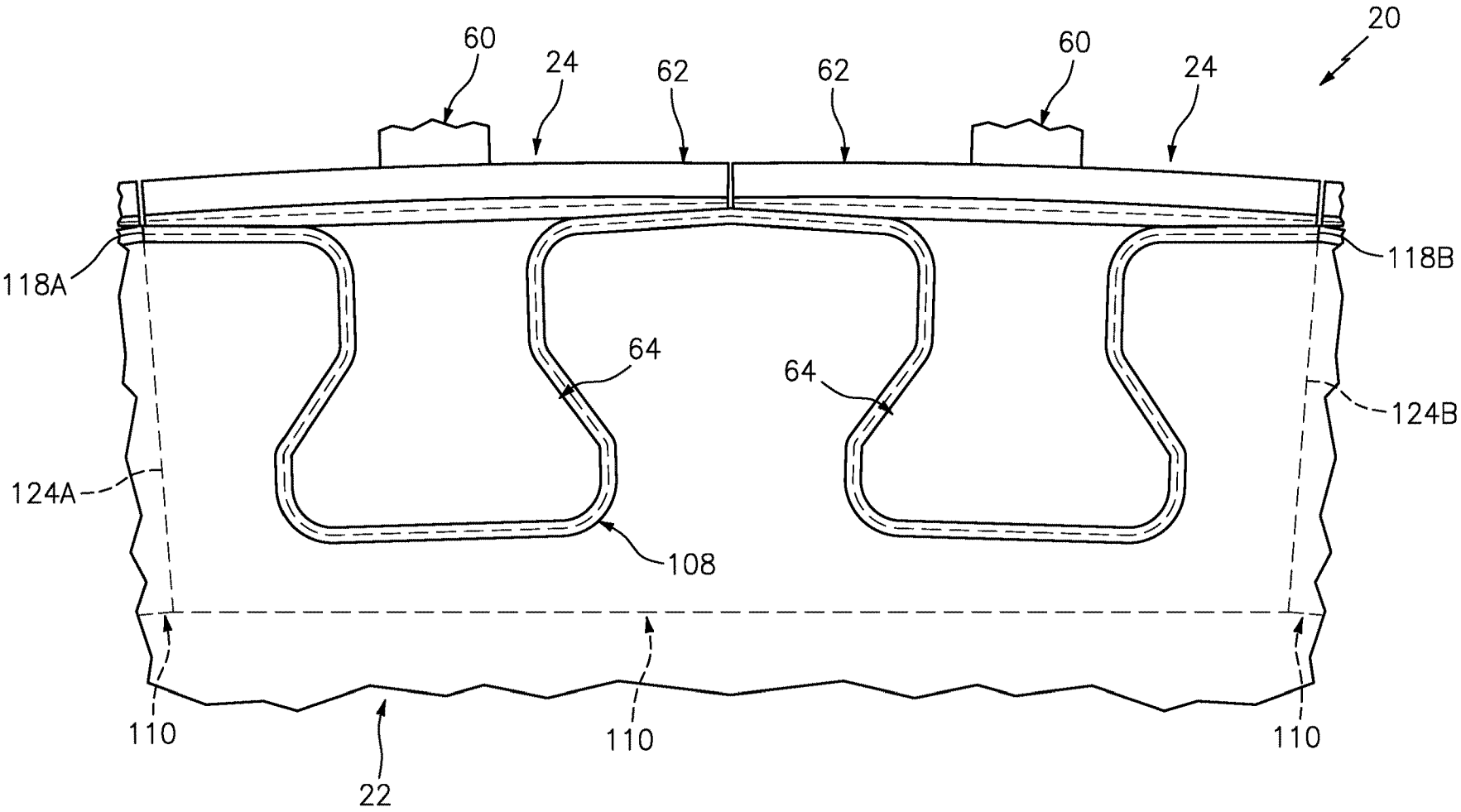
FIG. 16 is a partial end view illustration of another seal assembly configured with the rotor disk and the rotor blades.

In the embodiments described above, each rotor blade 24 is uniquely associated with a respective one of the seal elements 108 and a respective one of the blade plates 110. However, in other embodiments, each blade plate 110 may alternatively be configured to overlap a plurality of the rotor blade attachments 64 as shown, for example, in FIG. 16. Each seal element 108 may also or alternatively sealingly engage a plurality of the rotor blade attachments 64 as shown, for example, in FIG. 16.

Figure 17:
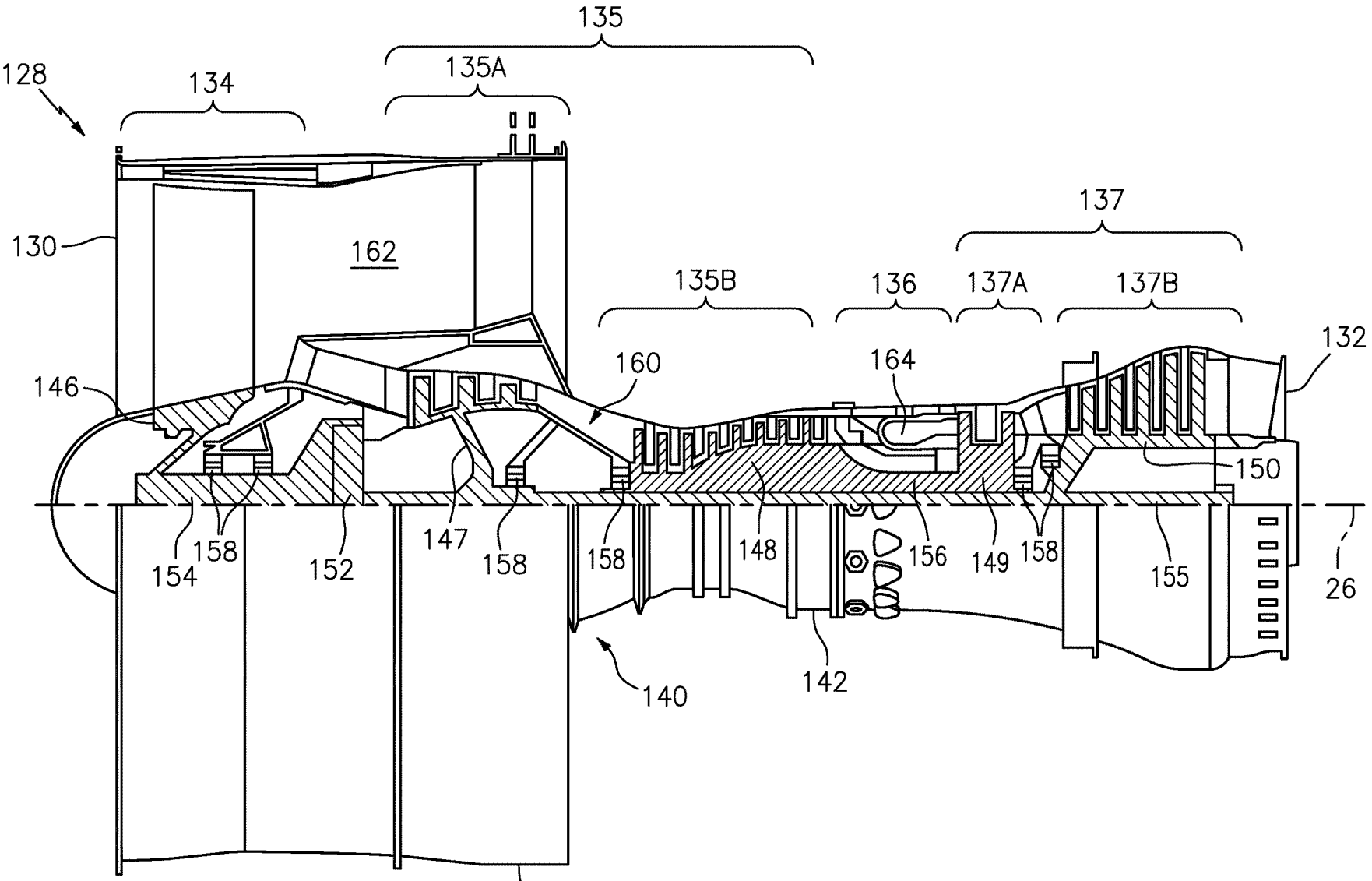
FIG. 17 is a side cutaway illustration of a geared turbofan gas turbine engine.

FIG. 17 is a side cutaway illustration of a geared turbine engine 128 with which the rotor assembly 20 of FIG. 1 may be included. This turbine engine 128 extends along the rotational axis 26 between an upstream airflow inlet 130 and a downstream airflow exhaust 132. The turbine engine 128 includes a fan section 134, a compressor section 135, a combustor section 136 and a turbine section 137. The compressor section 135 includes a low pressure compressor (LPC) section 135A and a high pressure compressor (HPC) section 135B. The turbine section 137 includes a high pressure turbine (HPT) section 137A and a low pressure turbine (LPT) section 137B.

The engine sections 134-137B are arranged sequentially along the rotational axis 26 within an engine housing 140. This housing 140 includes an inner case 142 (e.g., a core case) and an outer case 144 (e.g., a fan case). The inner case 142 may house one or more of the engine sections 135A-137B; e.g., an engine core. The outer case 144 may house at least the fan section 134.

Each of the engine sections 134, 135A, 135B, 137A and 137B includes a respective rotor 146-150, any one of which may be configured as or may include the rotor assembly 20 of FIG. 1. The rotor assembly 20, for example, may be included in one of the compressor rotors 147 and 148. Each of the rotors 146-150 of FIG. 17 includes a plurality of rotor blades arranged circumferentially around and connected to one or more respective rotor disks. The rotor blades, for example, may be formed integral with or mechanically fastened, welded, brazed, adhered and/or otherwise attached to the respective rotor disk(s).

The fan rotor 146 is connected to a gear train 152, for example, through a fan shaft 154. The gear train 152 and the LPC rotor 147 are connected to and driven by the LPT rotor 150 through a low speed shaft 155. The HPC rotor 148 is connected to and driven by the HPT rotor 149 through a high speed shaft 156. The shafts 154-156 are rotatably supported by a plurality of bearings 158; e.g., rolling element and/or thrust bearings. Each of these bearings 158 is connected to the engine housing 140 by at least one stationary structure such as, for example, an annular support strut.

During operation, air enters the turbine engine 128 through the airflow inlet 130. This air is directed through the fan section 134 and into a core gas path 160 (e.g., the gas path 76; see FIG. 4) and a bypass gas path 162. The core gas path 160 extends sequentially through the engine sections 135A-137B. The air within the core gas path 160 may be referred to as "core air". The bypass gas path 162 extends through a bypass duct, which bypasses the engine core. The air within the bypass gas path 162 may be referred to as "bypass air".

The core air is compressed by the compressor rotors 147 and 148 and directed into a combustion chamber 164 of a combustor in the combustor section 136. Fuel is injected into the combustion chamber 164 and mixed with the compressed core air to provide a fuel-air mixture. This fuel air mixture is ignited and combustion products thereof flow through and sequentially cause the turbine rotors 149 and 150 to rotate. The rotation of the turbine rotors 149 and 150 respectively drive rotation of the compressor rotors 148 and 147 and, thus, compression of the air received from a core airflow inlet. The rotation of the turbine rotor 150 also drives rotation of the fan rotor 146, which propels bypass air through and out of the bypass gas path 162. The propulsion of the bypass air may account for a majority of thrust generated by the turbine engine 128, e.g., more than seventy-five percent (75%) of engine thrust. The turbine engine 128 of the present disclosure, however, is not limited to the foregoing exemplary thrust ratio.

The rotor assembly 20 may be included in various turbine engines other than the one described above as well as in other types of rotational equipment. The rotor assembly 20, for example, may be included in a geared turbine engine where a gear train connects one or more shafts to one or more rotors in a fan section, a compressor section and/or any other engine section. Alternatively, the rotor assembly 20 may be included in a turbine engine configured without a gear train. The rotor assembly 20 may be included in a geared or non-geared turbine engine configured with a single spool, with two spools (e.g., see FIG. 17), or with more than two spools. The turbine engine may be configured as a turbofan engine, a turbojet engine, a propfan engine, a pusher fan engine or any other type of turbine engine. The present disclosure therefore is not limited to any particular types or configurations of turbine engines or rotational equipment.

While various embodiments of the present disclosure have been described, it will be apparent to those of ordinary skill in the art that many more embodiments and implementations are possible within the scope of the disclosure. For example, the present disclosure as described herein includes several aspects and embodiments that include particular features. Although these features may be described individually, it is within the scope of the present disclosure that some or all of these features may be combined with any one of the aspects and remain within the scope of the disclosure. Accordingly, the present disclosure is not to be restricted except in light of the attached claims and their equivalents.

What is claimed is:

1. A rotor assembly for a piece of rotational equipment, comprising:

a rotor disk configured to rotate about a rotational axis, the rotor disk extending axially along the rotational axis to a rotor disk end face;

a rotor blade including an attachment and a platform, the attachment attaching the rotor blade to the rotor disk, and the platform extending laterally between a platform first edge and a platform second edge opposite the platform first edge; and a seal element configured to seal a gap between the rotor disk and the attachment, the seal element having a longitudinal centerline that extends along an interface between the rotor disk and the attachment at the rotor disk end face, the seal element extending longitudinally along the longitudinal centerline between a seal element first end and a seal element second end, the seal element first end laterally aligned with the platform first edge, and the seal element second end laterally aligned with the platform second edge.

2. The rotor assembly of claim 1, wherein the longitudinal centerline follows a tortuous trajectory.

3. The rotor assembly of claim 1, wherein the seal element is seated in a groove formed by at least the rotor disk and the attachment.

4. The rotor assembly of claim 3, wherein the groove extends axially partially into the rotor disk from the rotor disk end face.

5. The rotor assembly of claim 4, wherein the rotor disk includes a slot surface that at least partially forms a slot in the rotor disk;

the attachment is seated within the slot; and the groove extends laterally partially into the rotor disk from the slot surface.

6. The rotor assembly of claim 4, wherein the rotor disk includes a slot surface that at least partially forms a slot in the rotor disk;

the attachment is seated within the slot; and the groove extends radially partially into the rotor disk from the slot surface.

7. The rotor assembly of claim 1, wherein the rotor disk comprises a dovetail slot; and the attachment is configured as a dovetail attachment that is seated within the dovetail slot.

8. The rotor assembly of claim 1, wherein the longitudinal centerline follows a U-shaped trajectory.

9. The rotor assembly of claim 1, wherein the seal element comprises a compliant seal element.

10. The rotor assembly of claim 1, wherein the rotor blade further includes an airfoil.

11. The rotor assembly of claim 1, further comprising:

a second rotor blade including a second attachment, the second attachment attaching the second rotor blade to the rotor disk, and the second rotor blade laterally adjacent the rotor blade; and a second seal element configured to seal a second gap between the rotor disk and the second attachment, the second seal element having a second longitudinal centerline that extends along an interface between the rotor disk and the second attachment at the rotor disk end face.

12. A rotor assembly for a piece of rotational equipment, comprising:

a rotor disk configured to rotate about a rotational axis, the rotor disk extending axially along the rotational axis to a rotor disk end face;

a rotor blade including an attachment and a platform, the attachment attaching the rotor blade to the rotor disk, and the platform extending laterally between a platform first edge and a platform second edge opposite the platform first edge;

a seal element configured to seal a gap between the rotor disk and the attachment, the seal element having a longitudinal centerline that extends along an interface between the rotor disk and the attachment at the rotor disk end face, the seal element extending longitudinally along the longitudinal centerline between a seal element first end and a seal element second end, and the seal element first end laterally aligned with the platform first edge; and a plate mounted to the attachment, the plate overlapping the attachment, and the seal element compressed axially between the plate and the rotor disk.

13. The rotor assembly of claim 12, wherein the plate is bonded to the attachment.

14. The rotor assembly of claim 12, wherein the plate extends laterally between a plate first side and a plate second side opposite the plate second side; and at least one of the plate first side is laterally aligned with the platform first edge; or the plate second side is laterally aligned with the platform second edge.

15. The rotor assembly of claim 12, further comprising:

a second rotor blade including a second attachment, the second attachment attaching the second rotor blade to the rotor disk, and the second rotor blade laterally adjacent the rotor blade;

a second seal element configured to seal a second gap between the rotor disk and the second attachment; and a second plate mounted to the second attachment, the second plate overlapping the second attachment and laterally adjacent the plate;

the second seal element compressed axially between the second plate and the rotor disk.

16. A rotor assembly for a piece of rotational equipment, comprising:

a rotor disk configured to rotate about a rotational axis, the rotor disk extending axially along the rotational axis to a rotor disk end face;

a rotor blade including an attachment and a platform, the attachment attaching the rotor blade to the rotor disk, and the platform extending laterally between a platform first edge and a platform second edge opposite the platform first edge; and a seal element configured to seal a gap between the rotor disk and the attachment, the seal element having a longitudinal centerline that extends along an interface between the rotor disk and the attachment at the rotor disk end face, the seal element extending longitudinally along the longitudinal centerline between a seal element first end and a seal element second end, and the seal element first end laterally aligned with the platform first edge, wherein the seal element comprises a rope seal element.

17. A rotor assembly for a piece of rotational equipment, comprising:

a rotor disk configured to rotate about a rotational axis, the rotor disk extending axially along the rotational axis to a rotor disk end face;

a rotor blade including an attachment, the attachment attaching the rotor blade to the rotor disk;

a second rotor blade including a second attachment, the second attachment attaching the second rotor blade to the rotor disk, and the second rotor blade laterally adjacent the rotor blade; and a seal element configured to seal a gap between the rotor disk and the attachment, the seal element having a longitudinal centerline that extends along an interface between the rotor disk and the attachment at the rotor disk end face; and the seal element further configured to seal a second gap between the rotor disk and the second attachment, and the longitudinal centerline extending along an interface between the rotor disk and the second attachment at the rotor disk end face.

* * * * *